73-151 SR
7/8/86 XR 4,599,046

United States Patent [19]

James

[11] Patent Number: 4,599,046

[45] Date of Patent: Jul. 8, 1986

[54] CONTROL IMPROVEMENTS IN DEEP WELL PUMPS

[75] Inventor: Robert G. James, Whittier, Calif.

[73] Assignee: Armco Inc., Middletown, Ohio

[21] Appl. No.: 482,957

[22] Filed: Apr. 7, 1983

[51] Int. Cl.[4] ..... F04B 49/02; F04B 49/06; E21B 47/00

[52] U.S. Cl. ..... 417/44; 73/151

[58] Field of Search ..... 417/44, 12, 53; 73/151, 73/505, 516 R

[56] References Cited

U.S. PATENT DOCUMENTS

| | | | |
|---|---|---|---|
| 3,343,409 | 9/1967 | Gibbs | 73/151 |
| 3,951,209 | 4/1976 | Gibbs | 73/151 |
| 3,992,952 | 11/1976 | Hutton | 73/505 |
| 4,015,469 | 4/1977 | Womack | 73/151 |
| 4,034,808 | 7/1977 | Patterson | 73/151 |
| 4,062,640 | 12/1977 | Gault | 417/415 |
| 4,064,763 | 12/1977 | Srinivasan | 73/516 R |
| 4,079,630 | 3/1978 | Friedland | 73/505 |
| 4,197,766 | 4/1980 | James | 417/415 |
| 4,286,925 | 9/1981 | Standish | 417/12 |
| 4,302,157 | 11/1981 | Welton | 417/44 |
| 4,496,285 | 1/1985 | Albert | 417/42 |

*Primary Examiner*—William L. Freeh
*Attorney, Agent, or Firm*—I. Michael Bak-Boychuk

[57] ABSTRACT

A counterbalanced, long stroke pumping system provided with a composite material lifting string is conformed for optimum separation between the frequency spectra entailed in the pump drive and the fundamental resonances of the string. This separation allows for an expanded control bandpass within which an adaptive control system may be rendered operative to adjust stroke mechanics to meet pump-off conditions or other pumping anomalies.

13 Claims, 23 Drawing Figures

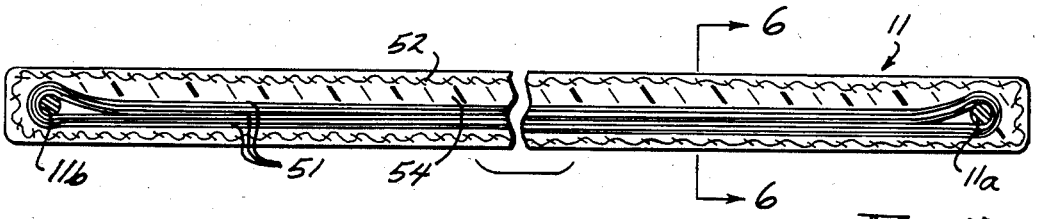
FIG. 5
FIG. 6
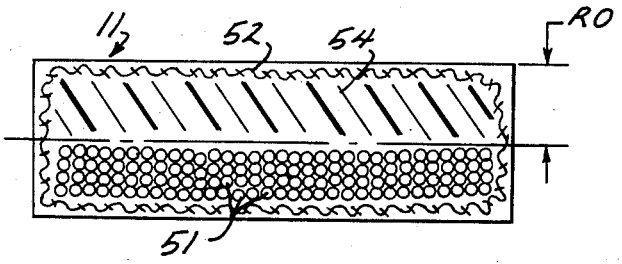
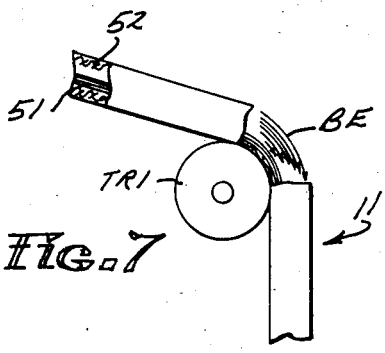
FIG. 7
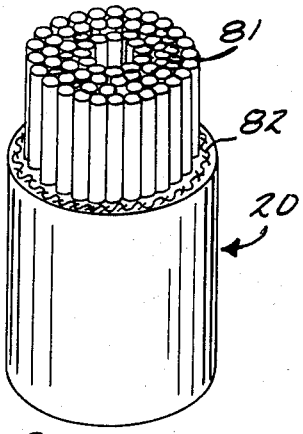
FIG. 8
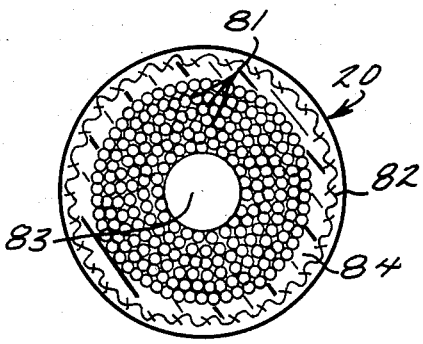
FIG. 9
FIG. 10
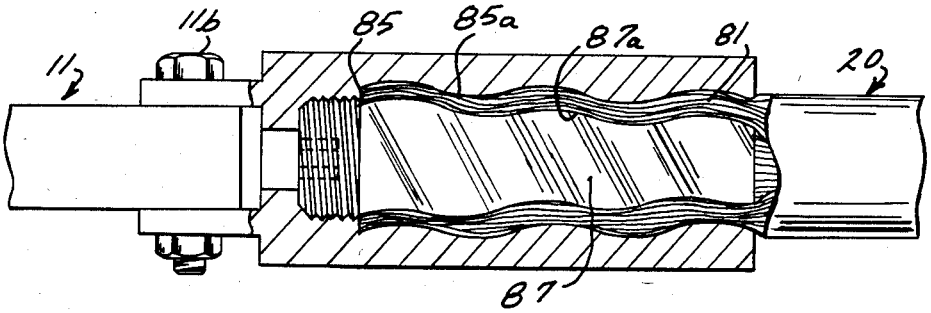

CONTROL IMPROVEMENTS IN DEEP WELL PUMPS

BACKGROUND OF THE INVENTION

1. Field of the Invention

The present invention relates to improvements in counterbalanced oil well pumps, and more particularly to improvements in the structure thereof.

2. Description of the Prior Art

As the readily available oil deposits are depleted the necessity for pumping from greater depths now occurs with increasing frequency. One limiting aspect of pumping at depths greater than three thousand feet is the length and weight of the rod string which, by itself, now comprises the major component of the pump. In particular, it is the fundamental resonance of the rod string, determined by the length and the string material, that is the source of most problems. Specifically, resonance is a product of the elastic modulus and mass density of the rod string structure which in materials like steel produce extremely low fundamental resonances. These low fundamental harmonics leave little room (i.e. frequency bandpass) for any control over the stroke rate since the practicalities of pumping push the rate right up to the resonance.

It should be understood that rod string resonance, like all classical resonances, entails a phase shift of 180°. Pumping at resonance will thus be effective only if the magnification factor is greater than 2, in effect doubling the elastic excursion of the rod string to produce the same flow rate. Even then, a resonance magnification factor greater than 2 is only obtainable in systems having a damping coefficient of less than 0.05, a coefficient not easily obtained in view of the many points of friction contact that may occur along any rod string. Thus deep well pumping, a problem considered herein, is not well suited for pumping at resonance, and development of techniques for raising such resonance in order to increase pumping rate are indicated.

Compounding the basic stroke rate problem are the many nonlinearities that usually occur in a pumping stroke. For example, the characteristics of any motor, whether it be electrical, hydraulic, or pneumatic, are generally non-linear, and any engagement thereof to the pump drive will necessarily involve impulse characteristics which carry the frequency components to excite the rod string. While this may be alleviated, or reduced to a great extent, by shaping the power onset impulse, there still remains the problem associated with limit nonlinearities in any pump drive. Simply, all pumping systems, whether classically linear or not, will include higher frequency components when driven to a limit. This high frequency component, if within the bandpass of rod string resonance, will excite this resonance to promote fatigue and eventually failure, without any increase in the effective work. The high cost of rod string replacement makes this a problem of first order importance.

In my prior U.S. Pat. Nos. 4,179,947 and 4,197,766 I have described a counterbalanced pumping system which, because of its features, provides well defined frequency spectra in the drive stroke and which, furthermore, may be directly mounted onto a well head. In brief terms, the foregoing system takes advantage of varying moment arms developed by wrapping flexible members around cams to produce a low frequency oscillatory mechanism. The result obtained is a long stroke, low frequency, pumping mechanism having fundamentals which are far removed from the fundamental resonance of the rod string, and which can be easily varied for optimum result. The combination of the features described in these prior patents effectively solve the problem of impulsive loading referred to above. As result of the foregoing improvements the impulse shapes entailed in applying and terminating power to the pump and at the stroke limits are both geometrically and electrically controlled, which is further optimized herein through the use of fully variable motors.

While the foregoing techniques effectively combine the efficiencies of an oscillatory system into a mechanism of a limited, well defined bandwidth, additional benefits may be obtained through the use of reinforced composite rod strings. In particular, one may note that wells are typically drilled to accommodate either a five or seven inch pipe, which by itself often limits the sectional size of the rod string. This is solved by the higher tensile strength of composites, which also offer higher resonances.

With the increased separation between the string resonance and the stroke rate with the use of variable motors it thus becomes possible to provide a control system which, both accommodates phenomena like pump off, and optimizes the pumping rate.

One should note that disruptive phenomena occurring at the lower end of the rod string is exhibited as rod string excitation. Thus impulsive loadings applied at the bottom end of the string, (normally associated with pump off or with any failure of the downhole pump plunger,) are, at best, seen indirectly at the surface as manifest amplitude changes in the rod string harmonics. Similarly, pump drive impulse at the top end of the rod string may excite these harmonics if the impulse shape includes the necessary spectra. In either case a control system set to decrease the rod string resonant energy is a control system which optimizes the rate between the flow rate limit (pump off) and the structural limit (resonance). It is such a control system that is disclosed herein.

While the prior art teaches various techniques for controlling pump rate, most require instrumenting directly the downhole pump. One may note that the rugged environment within the well bore renders any passage of instrumentation leads hazardous, and even when achieved, instrumentation signals are often insufficient to fully define the problem encountered. It is particularly significant to note that production of crude oil occurs in formations characterized by sand and debris, often entrained in the well fluid, which temporarily affect the operation of the downhole pump in the course of their passage. Simply, the operation of the downhole pump is at best "noisy". Accordingly, even fully instrumented downhole pumps require decision levels at the surface which, because of the expense of pulling an extremely long rod string for each anomalous signal, are carefully entertained. Thus it has quickly become the more preferred practice to install sufficient ruggedness in the downhole pump to ensure operation through such anomalies and which does not have to be pulled on each occurrence of a grain of sand.

Continuous or repetitive anomalies, on the other hand, cyclically load the rod string and excite harmonics resulting in exacerbation of fatigue and all efforts to reduce such prolonged cyclic loading must be under-taken in order to reduce pumping costs. Accordingly, a control system which distinguishes between the above-mentioned patterns in its response is necessary in order to maintain some reasonable returns on the equipment cost. For example, reductions in oil production as result of pump-off in the formation must be much more closely monitored in a deep well as opposed to a shallow well. Simply, the energy dissipated in various modes of a pumping stroke is substantially higher for a long rod string than it is for a rod string of less than three thousand feet. For this reason systematic improvements which combine both the improvement in rod construction and in the controls are necessary in order to optimize the pump. Simply, one has to obtain more bandwidth for any control system to operate in and once such bandwidth is achieved one must conform the control mechanism to operate in this bandwidth. It is the combination of these solutions that is described herein.

SUMMARY OF THE INVENTION

Accordingly, it is the general purpose and object of the present invention to increase the operative bandwidth of a well pump through the use of reinforced composite elements.

Other objects of the invention are to provide control techniques for use in a long stroke well pump which, in response to prolonged amplitude changes of the rod string modes, modify the pump rate.

Yet additional objects of the invention are to provide an improved long stroke well pump which automatically modifies its stroke rate to accommodate pump-off.

Further objects of the invention are to provide improvements in long stroke pump control achieved through the use of expanded control bandwidth.

Briefly, these and other objects are accomplished within the present invention by including in the structure of a counterbalanced pump system reinforced composite flexible elements which by virtue of their increased tensile properties increase the fundamental resonance of the rod string. This increase then allows for the installation of a control system by which the pump stroke rate is adjusted to accommodate pump-off and other anomalies.

To more clearly set forth the various resonances of a pumping system one should note that the natural oscillatory rate of a counterbalanced pump, in very linearized form, takes the following first order approximation:

$$I\frac{d^2A}{dt^2} + MA = 0$$

where:

I is the angular moment of inertia;

A is the angular displacement; and

M is the moment due to angular displacement from equilibrium.

This relationship does not include the effect of the rod string mass. The elastic frequency of the rod string, in turn, may be expressed as follows:

$$\sum_0^n m_1\frac{d^2e}{dt^2} + k_1e \ldots m_n\frac{d^2e}{dt^2} + k_ne = 0$$

where:

$m_n$ is the suspended mass increment;

$k_n$ is the elastic modulus increment; and e is the elongation.

For steel rod strings the above relationship has been found to approximate a first resonance as follows:

$$f_{fs} = 237000/1$$

where:

1 is depth, in feet. (see, for example, pp 101–103 of Sucker Rod Handbook, Bethlehem Steel 1953, Bethlehem, Pa.) The mass contribution of the rod string to the equations of motion of the counterbalanced pump can be expressed as:

$$MR\frac{d^2A}{dt^2} + MA = 0$$

where:

R is the cam radius.

Combining the above expressions results in a relationship:

$$(I + MR)\frac{d^2A}{dt^2} + (M + K)A + R\sum_0^n m\frac{d^2e}{dt^2} + ke = 0$$

which can be simplified as follows:

(i) the term I may be dropped out, being relatively small when compared with the rod string mass contributions;

(ii) the term K, corresponding to the effective motor spring constant, also provides a negligible contribution.

Thus, the simplified form of the above relationship is as follows:

$$MR\frac{d^2A}{dt^2} + MA + R\bar{m}\frac{d^2e}{dt^2} + R\bar{e} = 0$$

In this relationship the term M reflects the change in the moment with angle A which resolves itself as belt thickness t. Thus:

$$M \cong \sqrt{\frac{mgt}{2\pi}}$$

where g is the gravitational constant. Accordingly, the resonant frequency of the pump drive is approximated as $$fpd = \sqrt{\frac{gt}{2\pi R}}$$

which is thus determined by the ratio t/R.

The frequency of elastic motion of the rod string, in turn, may be selected by material choice. For example, by selecting aramid fiber rod strings the following ratios with steel are achieved:

$$\text{tensile strength } \frac{Ts_k}{Ts_s} = \frac{4}{2.5} \quad \text{(i)}$$

$$\text{modulus of elasticity } \frac{E_k}{E_s} = \frac{2}{3} \quad \text{(ii)}$$

$$\text{density } \frac{dk}{ds} = \frac{.05}{.28} \quad \text{(iii)}$$

which increases the first resonance as follows:

$$ffk = 592000/l$$

Thus the fundamental frequency of an aramid rod string, for example, increases by a factor of 1.8 to 2.5 the resonance of a steel string, increasing the separation between any rod string resonance and the pump drive. Such separation, furthermore, decreases any phase lag between the drive and the downhole pump and provides the bandwidth within which control can be exercised; both significant aspects in controlling pump-off, sometimes referred to as fluid pound. This natural pump frequency may be further modified by selecting the length of the individual belts such that a momentary unbalance occurs at the end of each stroke further modifying the base stroke rate. Thus the natural frequency spectrum of the counterbalanced pump may be limited by geometry while the rod string resonance is determined by material selection. What is more important, however, is that a reduction in the rod string mass m also reduces the effect of the rod string on the natural frequency of the pump drive. Simply, the $mR\ d^2A/dx^2$ component falls off linearly with the mass m as a product of increasing strength-to-density ratio of the composite while the MA term may be conveniently manipulated by selective thickness build-up in the belt.

Accordingly, the use of composite structures in the rod string and in the flexible connection allows for selection of appropriate dynamic range in the pump drive to meet the pump rate requirements at various depths. The heretofore unmanageable impulse response problem can thus be controlled by appropriate design choices according to the description following.

Having thus resolved the dynamics of pumping one may then select a control system which will accommodate phenomena like pump-off or fluid pound. It is such a control system, described herein, that both decouples the rod string harmonics from the effects of control and responds to characteristic patterns of pump-off. In brief terms, the control system senses the peak modal energy in the lower rod string modes and drives the pump rate to a selected energy level in the rod string. This, both drives the pump rate to a rate approaching rod string resonance and reduces the pump rate should pump-off be reached. Thus, the following effects are accomplished herein:

(a) by selecting material structures of substantially higher elastic strength-to-mass ratio substantially higher rod string harmonics are obtained;

(b) this same material structure may then be used for the belts wrapped around the mandrels of the counterbalanced pump thus allowing for further convenience in selecting pump dynamic response;

(c) by appropriate selection of the pump dynamic response a control system can be installed which drives the pump rate to a predetermined level of rod string harmonic spectrum, whether such results from resonance or from pump-off; and (d) within the same control system pattern filtering is achieved by sampling peak modal energy of the rod string, in the course of each stroke, to maintain the peak level of structural energy therein at the predetermined level. All the foregoing features are combined to advantage in the system set out herein, each having a benefit separate and beneficial of the other and each, when combined, resulting in a multiplied effect.

BRIEF DESCRIPTION OF THE DRAWINGS

FIG. 5 is a side view, in section, of a composite belt useful with the invention herein;

FIG. 6 is a sectional end view taken along line 6—6 of FIG. 5;

FIG. 7 is an end view of a turning roller illustrating the bending of the belt thereover;

FIG. 8 is a detail view, in partial section, of an inventive composite rod string;

FIG. 9 is a sectional end view of the rod string shown in FIG. 8;

FIG. 10 is a sectional side view of the end fitting on the composite rod string;

DESCRIPTION OF THE PREFERRED EMBODIMENTS

Figure 1:
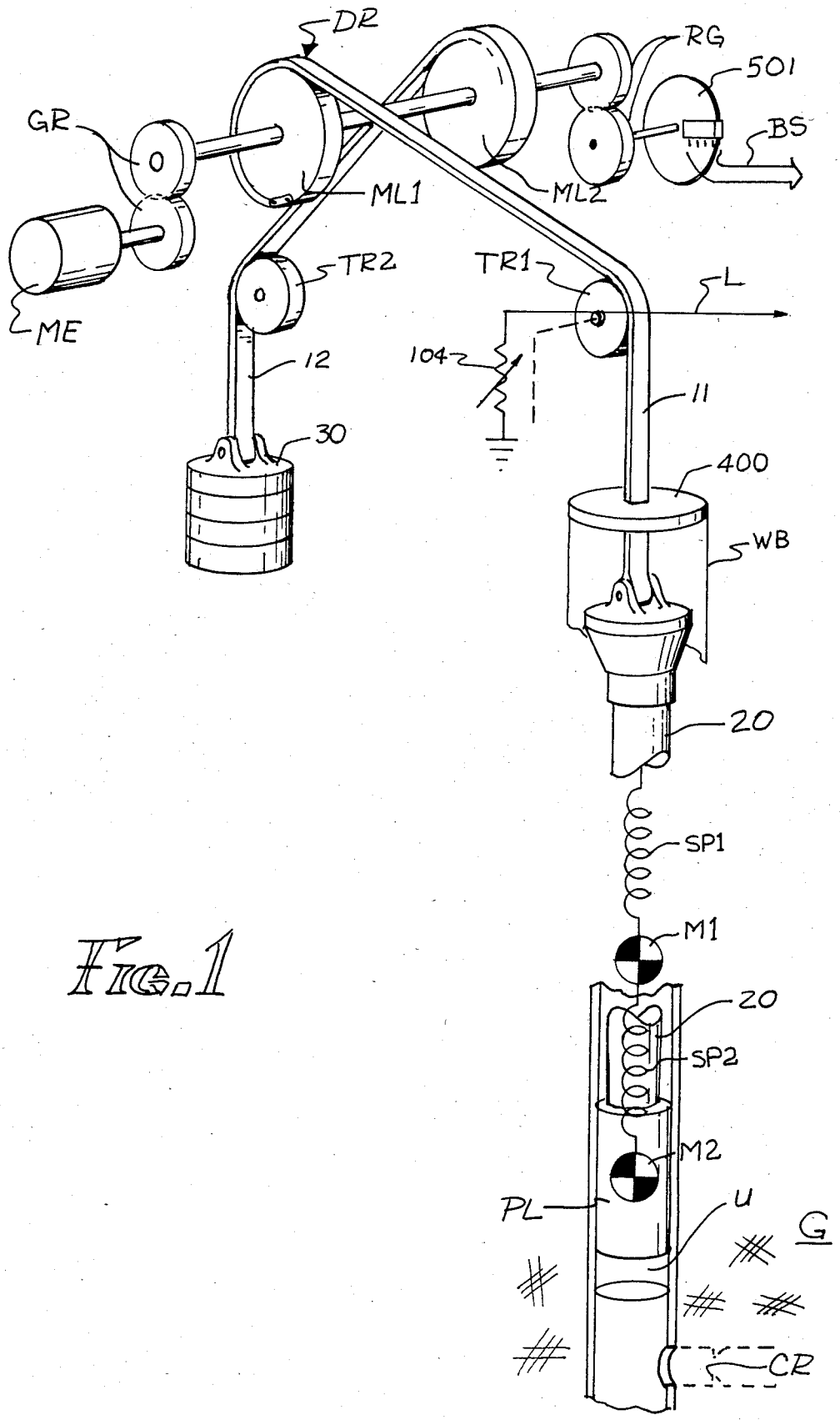
FIG. 1 is a perspective illustration of a counterbalanced pumping system instrumented for use with the invention herein.

In order to effectively present some of the control aspects in deep well pumping one should take reference to FIG. 1 wherein some of the major dynamic components are described. As shown in this figure a rod string 20, in its fundamental mode, may be characterized as a spring SP1 connected to a mass M1 representing the mass equivalent of the rod string. A second spring equivalent SP2 depends from mass M1 to support a plunger PL at the bottom of the well bore WB. Plunger PL, once again, may be characterized by its mass M2. As is typically practiced, plunger PL may include check valves and other hardware required in lifting oil to the surface which depend on the development of pressure differential for their seating and unseating. Thus the operation of plunger PL is typically characterized by small amplitude step functions having a base frequency equal to the stroke rate of the pump drive DR. While such base frequency essentially defines the lower spectrum, the step function character thereof also entails all other higher spectra which, invariably, excite the spring mass equivalents of SP1, M1 and SP2, M2. For this reason it is the prevailing practice in the art to maintain the pressure changes associated with plunger check valves at a minimum, thus minimizing the energy of the spectra which excite the rod string. While minimized, however, such excitation persists with the result that each stroke reversal is accompanied by some rod string excitation, referred to herein as "parasitic excitation."

Concurrent with the foregoing cyclic rod excitation other progressively developing anomalies appear. Such, however, are of non-parasitic form since the source thereof is not inherent in the pumping mechanism. One of the more problematic of such anomalies is the pump-off phenomenon, often referred to as "fluid pound."

To achieve some understanding of pump-off one may characterize the flow of crude oil CO through the formulation or ground G as equivalent to the passage of fluid through a choke restriction CR. As the oil is pumped migration of particulate matter entrained in the flow builds up around the well bore WB, reducing the effective size of choke CR. This process continues until the well is effectively rendered dry or until other channels open. Thus quite often the actual flow rate through the ground falls below the initial or estimated flow rate. As result of this recurring flow rate mismatch the pump volume below the plunger PL is often only partly filled, shown as ullage U, and on the downstroke the plunger is not opposed by liquid until this void is passed. At this point a large change in energy state occurs, in a step function form, entailing large spectral components in the resonance domain of the rod string. Such large level excitations impose heavy cyclic loading of the rod string, promoting fatigue and eventual failure. Furthermore, the energy level of the above impact increases quadratically with velocity of the plunger, which, in turn, depends on the height of the unfilled volume. Simply, the unbalance of the plunger PL during pump-off is essentially constant resulting in substantially fixed acceleration levels and the energy released at impact varies inversely with the void height.

In order to reduce the stroke rate for such pump-off in an automated manner the control system must necessarily discriminate between the parasitic loads and those caused by fluid pound. It bears emphasis that incipient pump-off is hardly distinguishable from the plunger noise. Simply, a small mismatch between pump rate and flow rate produces step functions similar to the closing of a check valve in the plunger PL substantially at the same point in the pumping stroke. Furthermore, the foregoing exemplary illustration in FIG. 1 grossly simplifies the rod string to a first several mode approximation. It should be understood that a rod string may be excited in many other modes and a simple comparison of the amplitude of one mode may therefore be trivial, particularly since the modes are somewhat determined by any contact that the rod string makes with the walls of the well bore. Thus, there is an inherent uncertainty in the distribution of the impact energy amongst the various modes. Simply, as the impact energy level increases the higher modes may be excited to more than their proportional extent.

Thus discrimination of pump-off entails necessarily discrimination by pattern, i.e., pattern recognition, rather than a simple amplitude discrimination. For these reasons the control system contemplated herein is conformed to operate according to the following general algorithm:

(a) The reversal portions of the pumping stroke are excluded from sampling for possible pump-off. This separates plunger noise from the spectrum considered.

(b) The descent portions of the stroke are then filtered for the bandpass of the lower rod string modes and the peak energy in each mode is then accumulated. This provides a maximum energy measure as it is distributed amongst the more significant modes.

(c) The stroke rate is then slowed down in inverse relationship with this energy level.

(d) This reduction in stroke rate continues until a predetermined level of modal energy is achieved.

In this manner the high impact levels due to pump-off are nulled out or, in the absence of pump-off, the system drives the stroke rate towards rod resonance. Thus the pump rate is optimized either to match the flow rate of the crude or to match the rate limited by rod string resonance. The foregoing algorithim will effectively correct the heretofore unmanageable problem of a statistical distribution of energy by modes. Simply, because of the many statistical variables fluid pound rarely produces a repetitive load pattern in the rod string since the particular modes excited in one stroke may not repeat in the next. The total energy, however, is substantially the same. Thus the comparison must necessarily be made on the basis of the total energy which, because of the various lags, may be variously distributed within one cycle. To solve this distribution one need only inspect the more basic modes which is simply achieved by collecting the peaks of the first few modes in any one cycle.

THE ANALYTICAL MODEL

The generic control pattern is particularly suited for a counterbalanced pump drive like that described in my prior U.S. Pat. Nos. 4,179,947 and 4,197,766, which separate the stroke reversals from the up and down portions of the stroke. For this reason the analytical model shown in FIG. 1 includes a belt or chain 11 extending from the top of the rod string 20 to pass over a turning roller TR1 for spiral storage on the periphery of a mandrel ML1. Mandrel ML1 may be fixed in rotation on a shaft ST which, through gearing GR, is tied to an electrical motor ME. It is to be understood that a second mandrel ML2 tied to a counterbalance 30 is similarly implemented but because of the length of support string is dynamically trivial and is therefore not considered at this point.

The foregoing analytical model, when limited to these first several modes, provides a dynamic response like that set out hereinabove by the relationship II, restated as follows:

$$(I + MlR)\frac{d^2A}{dt^2} + (M + KR)A + \sum_{0}^{n} RMl\frac{d^2e_1}{dt^2} + RSPle_1 \ldots = 0$$

Within this expression the term M may be approximated by the effective radial change of one belt thickness t in one revolution, or 6.28 radians. Thus:

$$M \approx \frac{Wt}{6.28} \approx \frac{migt}{6.28}$$

where g is the gravity constant.

In order to limit the possibility of resonance between the stroke rate and the rod string the foregoing relationship requires the following:

(a) that the term K be maintained low; and (b) that there be sufficient separation between the rod string resonance (f(e)) and the pump drive (f(A)).

Thus a relatively small electrical motor is indicated and a substantially stiff, high strength rod string is required. These features are necessary in order to maintain separation between the pump drive and the rod string harmonic which then renders any control corrections possible. Further separation can be achieved by raising the moment of inertia term I and the effective gear ratio of gears GR.

Accordingly, to render a control system operative, including the control system set out herein, substantial limitations are imposed on the rod string structure and the manner of applying power. It is the architecture of a control system incorporating all these features coupled with the teachings of an improved rod string that are set out herein.

THE IMPULSE RECOGNITION ALGORITHM

As stated above, the discrimination of rod impact level typically entails inspection of the various modes of rod motion. Simply, the total energy released at impact relates linearly to the fluid load and quadratically with the height of the unfilled column. Since the weight of the fluid column $W_f$ is predictable (simple volumetric computation) the only remaining uncertainty is the uncertainty of pump-off height or the height of the ullage U. Thus a relatively convenient means for discerning the amount of pump-off can be achieved by measuring the kinetic energy released into the rod string. Since a continuous power spectral breakdown is not practical or necessary only the first few modes need be inspected. These may be analytically expressed as follows:

$$Y = \sum_{1}^{n} (A_n \mathrm{Cos} W_n t + B_n \mathrm{Sin} W_n t) \mathrm{Sin} \frac{n\pi x}{1}$$

where y is the deflection, A and B are arbitrary constants of solution, $W_n$ is the frequency of each mode, x is the distance along the rod string and n is the mode number. This expression can be further simplified if certain approximations can be made on the rod string fundamental resonance calculation. By simply following the classic rules of superposition the exact function of y need not be defined. It is cardinal to the understanding of the control scheme envisioned herein to appreciate that in all conservative systems potential energy exchanges with kinetic energy. A continuous monitoring of the total energy is therefore unnecessary. All one need do is to measure the peak potential energy (peak load) of the various modes, whenever such occur in a stroke cycle, to determine the energy released into the rod string. The inherent character of pump-off renders this approach even simpler. Specifically, one may note that the void caused by pump-off acts as a pneumatic cushion and thus contains less in the higher frequency spectra than an idealized step function. Thus the impact itself limits the number of significant modes. For a more expanded treatment of elastic systems one may refer to Frankland J. M. "Effect of Impact on Simple Elastic Structures," Proceedings of the Society of Experimental Stress Analysis 6(1948):7–27 and others. Thus by removing the potential to kinetic exchange or time from the above relationship the peak amplitude of each mode within a stroke provides the peak impact energy content. Furthermore, such record of peak amplitude need only be taken for the first few modes. Based on these considerations a control system is set forth hereinbelow.

Figure 2:
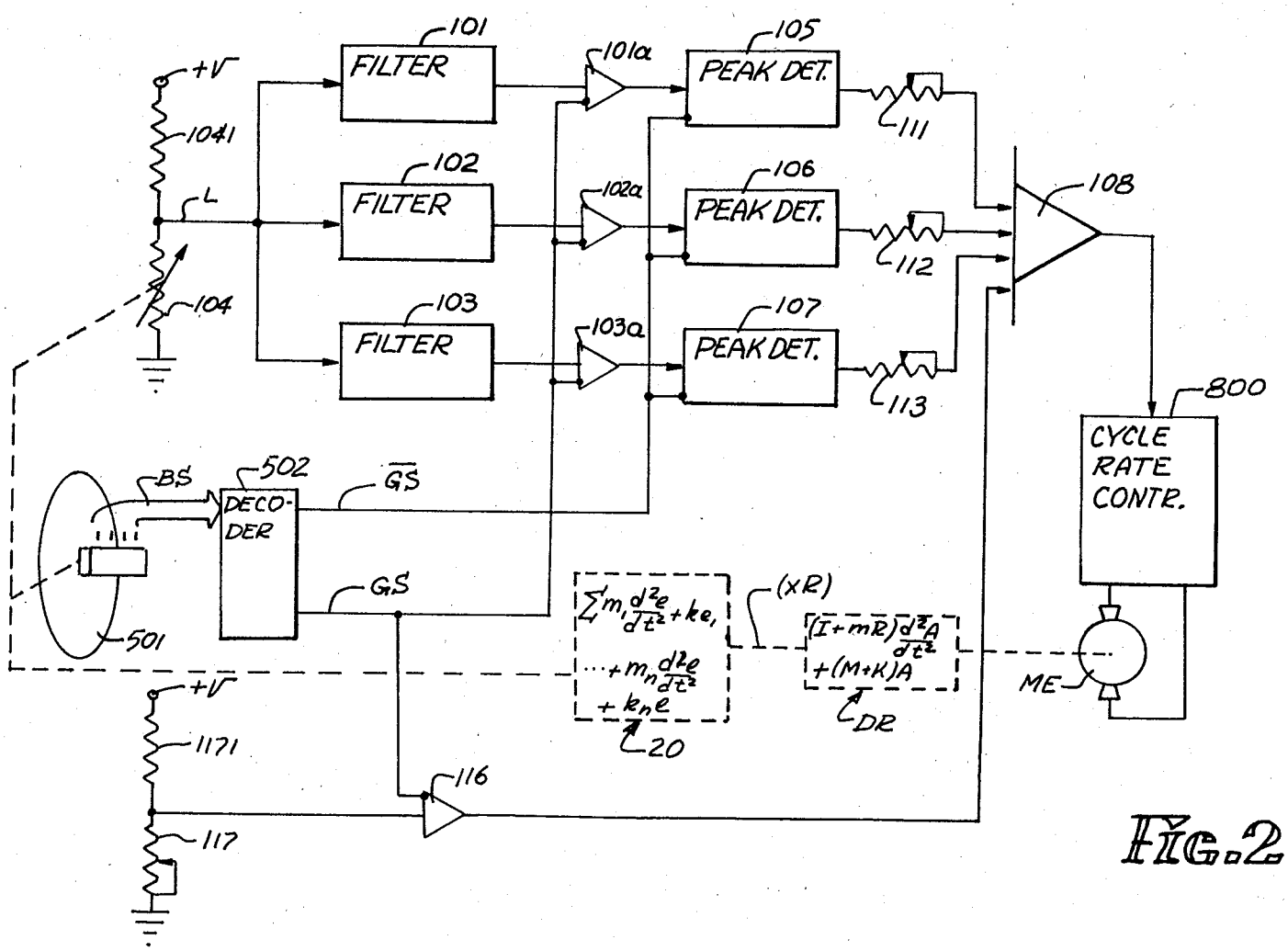
FIG. 2 is a block diagram of a control system constructed according to the present invention.

As shown in FIG. 2 three bandpass filters 101, 102 and 103 are connected to the load sensing device or strain gauge 104 carrying the load signal L of the various rod string modes on top of the pump loading each being connected across a corresponding analog gate 101*a*, 102*a* and 103*a* to a corresponding peak detector 105, 106 and 107. Detectors 105–107, in turn, are summed in a summing amplifier 108. The effective output of amplifier 108 thus forms the following algorithm:

$$Y_{max} = \sum_{1}^{n} Y_{P1} + Y_{P2} \ldots Y_{Pn}$$

where $Y_{P1}$–$Y_{Pn}$ are the peak load deflections of each mode. Since, as stated, potential energy exchanges with kinetic energy the foregoing expression satisfies the requirement of conservation. One must note, however, that the kinetic energy, furthermore, entails a measure of cycle rate with the result that the maximum of the kinetic energy within one stroke relates as follows:

$$KE_{max} = \sum_{1}^{n} QW_1^2 Y_{P1} + QW_2^2 Y_{P2} + \ldots QW_n^2 Y_{Pn}$$

Accordingly, operational amplifier 108 is provided at the input thereof with input resistors 111, 112 and 113 related to each other as the inverse of the mode frequency $W_1$–$W_n$, e.g., the resistance of input resistor 112 relates to resistor 111 by the ratio of $(W_2/W_1)^2$ and similarly the resistance of resistor 113 relates to resistor 111 as $(W_3/W_1)^2$.

This compensation arrangement effectively corrects for the energy product of resonant rate and amplitude. Resistors 111, 112 and 113, however, may be further used to adjust for the increased damping that occurs at the higher modes or for any modal preference that is exhibited by the rod string.

It is to be understood that the foregoing measure of rod string modal energy is preferably taken during the course of the downstroke of the plunger PL, ie, during such times as the pump-off inpact will actually occur. Furthermore, such measurement should occur outside of the reversal region to isolate the parasitic loads that may occur as result of seating and unseating of ball valves in the plunger. To achieve this necessary stroke coordination the shaft ST in FIG. 1 may be provided with reduction gearing RG reducing the rotary motion of the shaft to less than one turn, gearing RG in turn driving a shaft encoder 501 to produce a binary signal BS to a decoder 502 in FIG. 2. Decoder 502, which may be variously implemented, but which effectively operates as an R-S flip flop set and reset by selected ranks on the shaft encoder, provides a gating signal GS to the analog gates 101*a*, 102*a* and 103*a* enabling these gates when the plunger PL is on its way down. Concurrently signal GS may gate yet another analog gate 116 which at its input receives a reference signal RS developed by a potentiometer 117. The output of gate 116 is then collected at the input of summing amplifier 108. This allows the operator to set the desired level of rod string energy at which pumping is to be maintained. Thus gates 101*a*, 102*a* 103*a* and 116 open for the passage of signals during a selected portion of the downstroke as determined by signal GS. At the completion of this interval the inverse of this signal, shown as signal GS from decoder 502, clears or discharges peak detectors 105–107.

Accordingly, the output of amplifier 108 shall store, at the end of each gating interval, the total of the maxima of the modal energy of the rod string in that interval reduced by the bias signal RS. This signal sum may then be applied to a cycle rate controller 800 which controls the electrical motor ME according to the description following.

In the foregoing manner a measure of energy released through the pump-off impact is resolved, resolving the control input. One may note further that the absolute value of gain need not be determined to any certainty since such only sets the response rate, or the number of strokes within which any correction takes place.

By further reference to the above approximations, the maximum energy level relates to the flow rate as follows:

$$KE_{MAX} = \Delta\text{Height} \cong \text{Pump Rate}\Big|_{AVE} - \text{Flow Rate}\Big|_{AVE}$$

Thus:

$$Q\sum_{1}^{n} W_1^2 Y_{P1} + W_2^2 Y_{P2} \ldots W_n^2 Y_{Pn} \cong \text{Pump Rate} - \text{Flow Rate}$$

where $Y_{P1} \ldots Y_{Pn}$ are the modal peaks which appear at the measurement pickoff at arbitrary phase angles and propagation delays.

Accordingly, storage of the various mode peaks resolves this propagation or phasing uncertainty without any substantial loss in system fidelity. More importantly, the technique of modal peak detection accurately duplicates the energy released in the course of fluid pound.

Thus the only substantial uncertainty in discriminating pump-off by this technique is the uncertainty of measurement accuracy, an uncertainty inherent in all control systems, and not any uncertainty of wave form synthesis or load shape prediction. In addition, the use of bandpass filters set to pass modal frequencies of the rod string takes advantage of the extensive rod string technology developed in the art while attenuating other spectral components of which much less is known.

More importantly the present control scheme also drives the stroke rate to a maximum as part of its inherent function. Specifically, motor ME modifies the operation of the pump drive DR which then may couple into the motion of the rod string 20 through the radial effect R according to the relationships set out. The coupling of the drive dynamics into the rod string, once again, is determined by the modal motion of the rod string. Thus in order to maintain sufficient control range or authority and to allow for isolation of the stroke (pumping) loads from those of rod string resonance, frequency separation between the drive DR and the rod string must exist.

THE CONTROL ALGORITHM

Recapitulating FIGS. 1 and 2, the pump drive DR is provided with shaft encoder 501 which, in binary or other code, provides an output indicative of the angular position of the shaft ST. Since the drive DR entails multiple turns of the shaft ST during the course of one stroke encoder 501 is geared by gear box RG to provide less than one turn therein for each stroke dimension. One or more of the significant bit leads of encoder 501 can then be utilized to separate those portions of the stroke that are substantially free of the parasitic excitations described above thus isolating the up and down segments of the stroke as set forth above. Accordingly, the parallel output bus BS from encoder 501 may be decoded for position and the direction may be resolved by appropriate logic.

Figure 3:
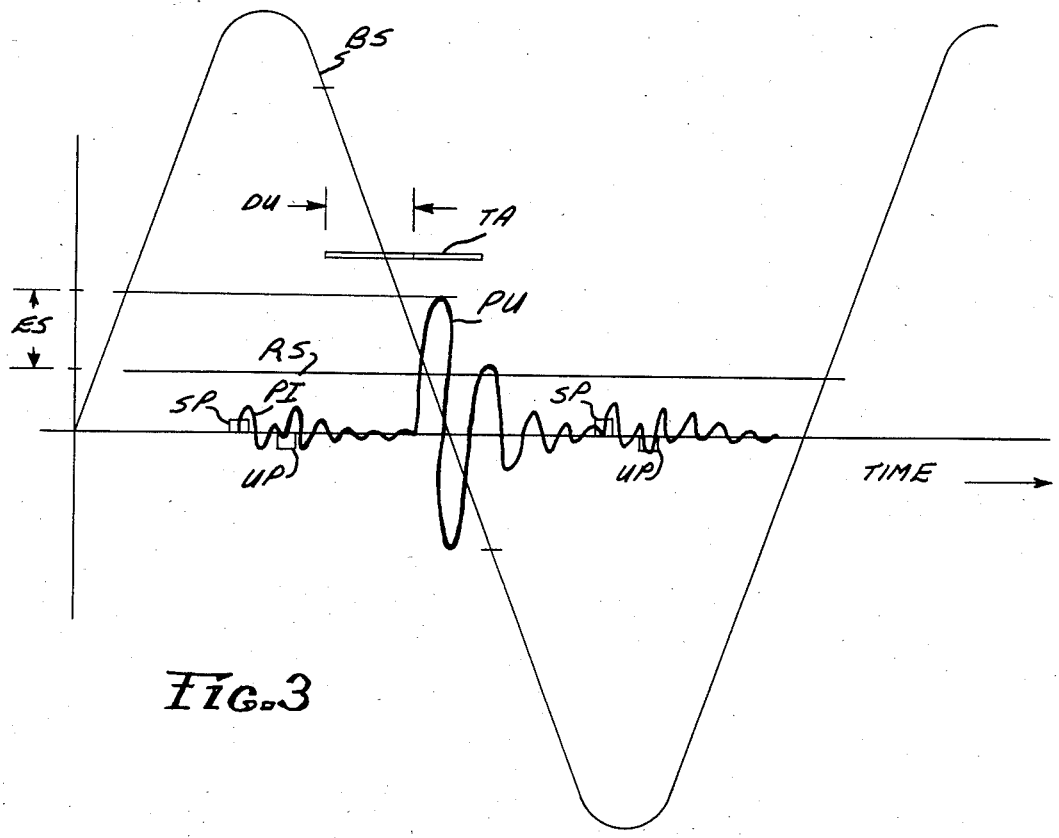
FIG. 3 is a wave form diagram illustrating the various functions entailed in the present invention.
Figure 12:
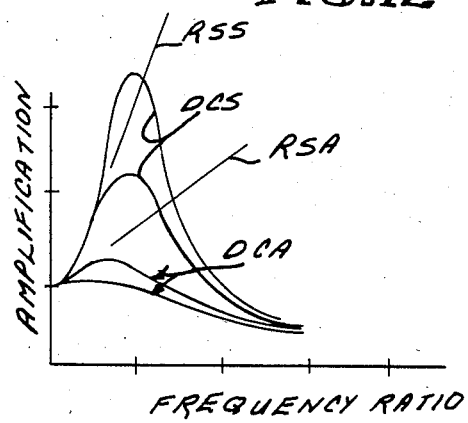
FIG. 12 is a graphical comparison of the damping functions of steel and composite rod strings.

Thus as shown in FIG. 3 the position signal BS gates timing apertures TA which follow the seating and unseating pulses SP and UP in the plunger PL. These set off the parasitic modes of rod string motion P1 which substantially decay at the aperture TA. Aperture TA is selected to occur on the downstroke at the point when the pump-off impulse is likely to happen. Pump-off thus corresponds to the unopposed motion of the plunger through the ullage U, shown as interval DU, with a consequent modal energy release PU which is directly related to the size of this interval. Thus:

$$\text{PU} - \text{CDU} = \text{Flow Rate} - \text{Pump Rate}$$

where PU may be resolved into its modal components as set forth above.

$$Q\sum_{1}^{n} W_1^2 Y_{P1} + W_2^2 Y_{P2} + W_3^2 Y_{P3} \ldots = PU$$

The peaks of signal PU thus resolved into modal components by the filters 101, 102 and 103 are then compared against the reference signal RS to produce an error signal ES at the output of amplifier 108. The stroke rate of the pump drive is then reduced in correspondence with signal ES.

It is of particular interest that the setting of potentiometer 117, or the selection of signal RS, is virtually self checking. Simply, if RS is set below the maximum level of the parasitic excitation PI the cycle rate of the pump will eventually stop, since under these conditions the error signal ES cannot be nulled out. Similarly if RS is set too high the cycle rate of the pump drive itself drives the rod string into resonance with physically perceivable noise levels. Thus observation by the operator will quickly resolve the proper operating range for signal RS.

Beyond the above experimental approach the simple expedient of marking the proper range on potentiometer 117 may be utilized for setting the operating point of the system.

In the foregoing discourse it is necessary to note that the maximum modal energy occurs at resonance with the drive DR. The operating rate is thus limited by the resonance of the rod string. Any pump-off excitation, furthermore, will occur at the rod string resonance, at energy levels lower than the energy at system resonance. Thus rod string construction to increase its resonant frequency is of paramount significance both for improving pump flow rate and for reducing energy dissipated in the event of an anomaly.

THE ROD STRING CONSTRUCTION

Before proceeding with the structure of the rod string one may first consider the shape of the driving impulse obtained through the pump drive DR. Referring back to the relationships setting forth the dynamics of motion it is noted that the natural frequency of the pump drive DR itself is mostly determined by the ratio of the moment arm change due to belt stacking versus the rotary inertia around the shaft ST. Thus:

$$W_{DR} \cong \sqrt{\frac{\frac{2gmt}{6.28}}{I}}$$

where $W_{DR}$ is the linearized frequency of the pump drive, m is the weight of the suspended structure divided by the gravitational constant, t is the belt thickness and I is the moment of inertia. This natural frequency of the pump drive, however, is greatly modified by the moment due to the acceleration of the suspended rod string weight. Thus:

$$W_{DR+W} = \sqrt{\frac{\left[\frac{2gmt}{6.28} + K\right]}{[I + mR]}}$$

where R is the approximate radius of the belt stack and K is the motor spring constant. Accordingly, for light weight installations where the mandrel inertia is virtually negligible and the motor is small:

$$W_{DR+W} = \sqrt{\frac{2gt}{2\pi R}} = \sqrt{\frac{2gt}{6.282R}}$$

Figure 4:
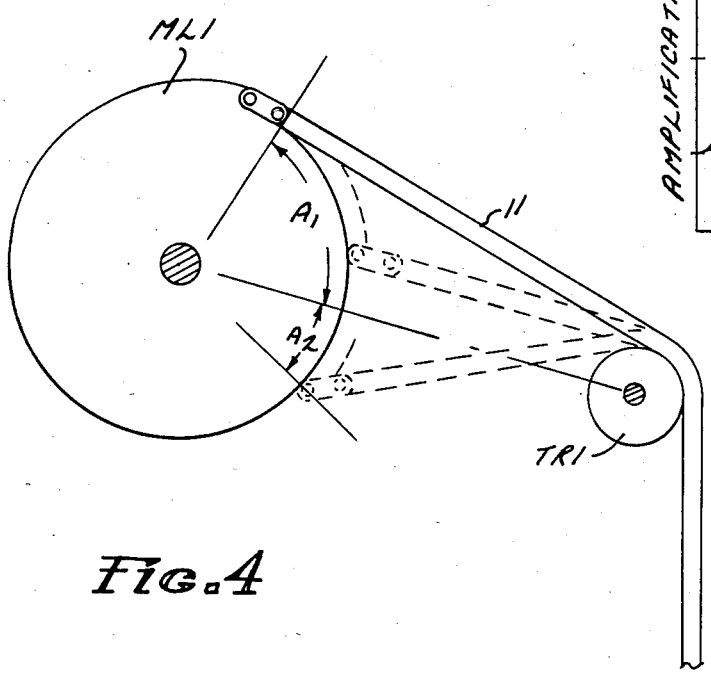
FIG. 4 is an end view of a mandrel illustrating the alignment thereof in the course of stroke reversal.

By virtue of this characteristic relationship one may easily obtain such natural frequency as is desired by the simple expedient of modifying the belt thickness t and the radius R of the mandrel. Accordingly, the base linear frequency obtained through the pump drive is easily controlled. A linear system, however, is not always compatible with AC motors which preferrably operate close to AC synchronous speed. For this reason end conditions have been provided, according to the description in my copending application Ser. No. 220,435, which provide reversing impulses at the end of each belt extension. These effectively modify the pump motion to a compound, non-linear state which, at best, is heuristically approximated. Simply, as shown in FIG. 4 within the angle interval $A_1$ to $A_2$ substantially all the kinetic energy in the system is reversed where the angle A2 is preferrably less than 90°. Thus if the maximum kinetic energy in the drive system is approximated as follows:

$$KE_{SYS} = \tfrac{1}{2}(RW_{DR+W})^2 2m$$

$$KE_{SYS} = W^2R^2m$$

and doubled for full reversal:

$$2KE_{SYS} = 2W^2R^2m$$

then the potential energy impulse necessary for reversal relates like the function g/R. Based on these relationships $$\left(\text{i.e., } W_{DR+W} = f\sqrt{\frac{t}{R}} \text{ and } W_{REV} = f\sqrt{\frac{g}{R}}\right)$$

higher frequency terms will be associated with the reversal impulse than those caused by the linear portion of the cycle. Thus any dynamic character of the rod string must necessarily be sized for the reversal spectrum, this being the most stringent constraint.

To meet the stringent reversal impulse waveform two alternate solutions are possible: the first drives the radius R to large dimensions while the second drives the rod harmonics high. Large radial dimensions, however, dictate large pump configurations, an undesirable feature, and the necessary approach therefore must consider reductions in rod string weight. One successful technique in reducing rod string weight while maintaining high elastic moduli is the use of aramid composites, particularly composites reinforced by fibers sold under the mark "Kevlar 49" by E. I. DuPont DeNemours & Co. (Inc.) Wilmington, Del. 19898. As previously summarized, this reinforcing fiber provides rod string harmonics in the following order of magnitude:

$$f_{Rod\ Kevlar} \cong \frac{5 - 600{,}000 \text{ cycles/min.}}{l}$$

where 1 is the rod length in feet. A similar figure for steel rod strings provides the following:

$$f_{Rod\ Steel} \cong \frac{237{,}000 \text{ cycles/min.}}{l}$$

Thus approximately a 1.8 to 2.5 multiple in fundamental rod frequency is obtained through the use of Kevlar reinforced composites. With a 10,000 foot long rod string a 1 cps fundamental is obtained in a Kevlar reinforced composite rod string which provides favorable separation from the drive harmonics as determined by the realistic ranges of t and R (e.g., $t/R < 10$ and $R < 4$ feet). More importantly, however, use of reinforced composites may also extend into the belt structure thus allowing a wide variation in the relationship t/R.

Accordingly, aramid reinforced composites both allow for an increased separation between the rod string harmonic and the frequency domain of the pump drive, while also allowing selection over the energy exchange in the stroke reversal period. In addition, the high internal damping of aramid fibers provides further isolation of the parasitic noise occurring at each stroke reversal, thus further separating the rod string motion associated with pump-off from reversal transients.

Accordingly, a pumping system of the type described in my prior U.S. Pat. Nos. 4,179,947 and 4,197,766, shown in FIG. 1, may be provided with reinforced composite belts and rod strings according to the present improvement. As stated above this pumping system comprises a pump drive DR driven by a reversible electric motor ME which through a gear train GR drives a shaft ST on which a first and second mandrel ML1 and ML2 are mounted. Each mandrel stores, in opposed spiral stack-up about the periphery thereof, a corresponding flexible belt 11 and 12, each being formed in the manner of a composite ribbon according to the description following. Belts 11 and 12 respectively pass over turning rollers TR1 and TR2 to support at their free ends a composite rod string 20 and a counterbalance support 30. For reasons more aptly set forth hereinbelow belts 11 and 12 are wrapped in the same direction around the respective mandrels ML1 and ML2 and the corresponding rollers TR1 and TR2 with the result that the same interior wrap surface of each belt experiences minimal elongation through bending. Thus it is possible to accommodate various t/R ratios of belt thickness to mandrel radius while maintaining one belt surface essentially free of bending elongation.

As shown in FIGS. 5 and 6 belt 11, (and by common function belt 12), is formed by wrapping a continuous wrap of aramid filaments 51 around two clevis pins 11*a* and 11*b* which may form the end connections. This longitudinal filament wrap may then be immersed in a filler or potting compound 54, aligned in the manner of an elongate ribbon, to form a stratum of reinforcing structure close to one surface of the belt. In this manner a filament free region RO is formed which will experience most of the bending elongation when the belt is laid with the reinforced side next to the mandrel and the turning roller. Thus various dimensions of belt thickness t may be achieved, so that the desired t/R levels are met.

This belt structure may be further hardened against abrasion by wrapping the cast ribbon of the filler compound 54 with a loosely woven wrap 52 which is thereafter once again impregnated with the potting compound. By virtue of this arrangement of component elements a belt structure is formed wherein the loose weave of the wrap 52 allows for the necessary bending elongation BE while the load is carried by the filaments 51 on the interior surface. This effect is shown in FIG. 7 illustrating the deformation of the belt BE as it is turned over roller TR1.

It is to be understood that in the foregoing belt example a continuous filament strand is utilized. The fixing of the ends of the strand 51 then requires sufficient shear transfer to the other filament segments to accommodate the load carried thereby. By the same considerations multiple strand segments may be utilized, including strand segments just longer than the belt, providing sufficient overlap of the ends to carry the load.

Rod string 20 may be similarly constructed of a composition reinforced by aramid fibers 81, as shown in FIGS. 8, 9 and 10. As shown in these figures fibers 81 may be clustered in an annular arrangement around a central cylindrical filler bland 83, to control buoyancy, and thereafter wrapped in a loosely woven wrap 82 against abrasion. The combination may then be impregnated with a suitable filler or potting compound 84 for transferring, by shear transfer, any load differentials between the filaments. To provide for an end attachment filaments 81 may be inserted into a frusto conical interior cavity 85 of an end fitting 86 to be compressed thereat by a conical plug 87. Fitting 86 may be variously conformed to provide a clevis for engaging pin llb or to attach to the downhole pump assembly (not shown) in a manner known in the art. To insure good clamping characteristics the interior surface of cavity 85 as well as the opposing surface of plug 87 may include spiral waves 85*a* and 87*a* between which the strands 81 are clamped.

Alternatively, one may utilize the various end connections for retaining cable strands known in the art, as for example taught in U.S. Pat. Nos. 4,179,947, 4,197,766.

By virtue of the foregoing arrangements, a rod string having the strength characteristics of the aramid fibers is formed thus providing the foregoing advantages over steel rod strings:

$$\text{tensile strength: } \frac{4.0}{2.5} \quad \text{(a)}$$

$$\text{elastic modulus: } \frac{2.0}{3.0} \quad \text{(b)}$$

$$\text{density and/or mass: } \frac{.05}{.28} \quad \text{(c)}$$

These ratios result in an increase in fundamental frequencies by a multiple of approximately 1.8 to 2.5. In addition, a substantial increase in internal damping is obtained where the internal damping of steel tube approaches 0.02 while the same damping coefficient for aramid fibers ranges between 0.3 and 0.7.

THE CONTROL SYSTEM

Having thus increased the natural frequencies and structural damping of the rod string heretofore unachievable control over pump-off is now rendered possible. Specifically, one may want to note that substantially all of the prior art pump-off controllers in essence shut down the pump drive on the occurrence of pump-off. The drive then remains shut down for a preselected period, allowing more oil to migrate towards the downhole pump. At that point the drive is restarted and continues until the next pump-off occurs. Thus a repeated incidence of pump-off pound is a matter of design, greatly increasing the level of any fatigue cycles and therefore reducing rod life.

By selecting rod structures having increased frequency ranges and increased damping, closed loop control over pump-off is rendered possible. Thus not just an improvement but an increment in type is achieved by appropriate selection of the control system, its gain and its bias.

Referring back to FIG. 2 the control system, generally designated by the numeral 100, comprises heretofore mentioned strain gauge sensor 104 which may be variously placed to measure the load on the belt 11, sensor 104 feeding to the above described peak spectral analyzer. Concurrently, shaft encoder 501, through a decoder stage 502, provides a stroke position signal which acts as the gating strobe. Thus the output of gauge 104, indicating the load on belt 11, is gated during selected portions of the stroke thereby selecting those load impulses that may be related to pump-off. This same information, however, also includes a measure of the rod motion caused by the pumping stroke itself. Since both of these effects are not predictable with any certainty, the control system is necessarily assigned the task of storing the various modal peaks within the gating aperture, as such appear on the surface.

Thus, as suggested above and as will be described in more detail below, the control system is assigned the task to store and sum, in frequency normalized relationship, the energy levels in the various rod string modes regardless of their origin, and attempts to modify the pump stroke rate to bring the total energy to a selected level.

Accordingly, the stroke rate of the pump drive DR is slowed down in an inverse relation with the peak modal energy stored. Concurrently, the stroke rate is accelerated by the bias signal BS. Thus an equilibrium condition will be achieved, by selecting appropriate gains, where the total mode energy in each stroke just matches the bias signal. In this manner the stroke rate will adapt to the lowest practical energy level, thus matching the pumping rate to the rate of propagation of the crude oil through the ground G.

Of exceptional interest is the condition that the same control arrangement, in the absence of any flow limitations, will drive the stroke rate of the pump drive DR up to the first modal resonance of the rod string. This is illustrated in FIG. 2 by the equivalent loop connection, shown in broken line, comprising the structural feedback of the drive DR which couples back into the rod string.

Figure 11:
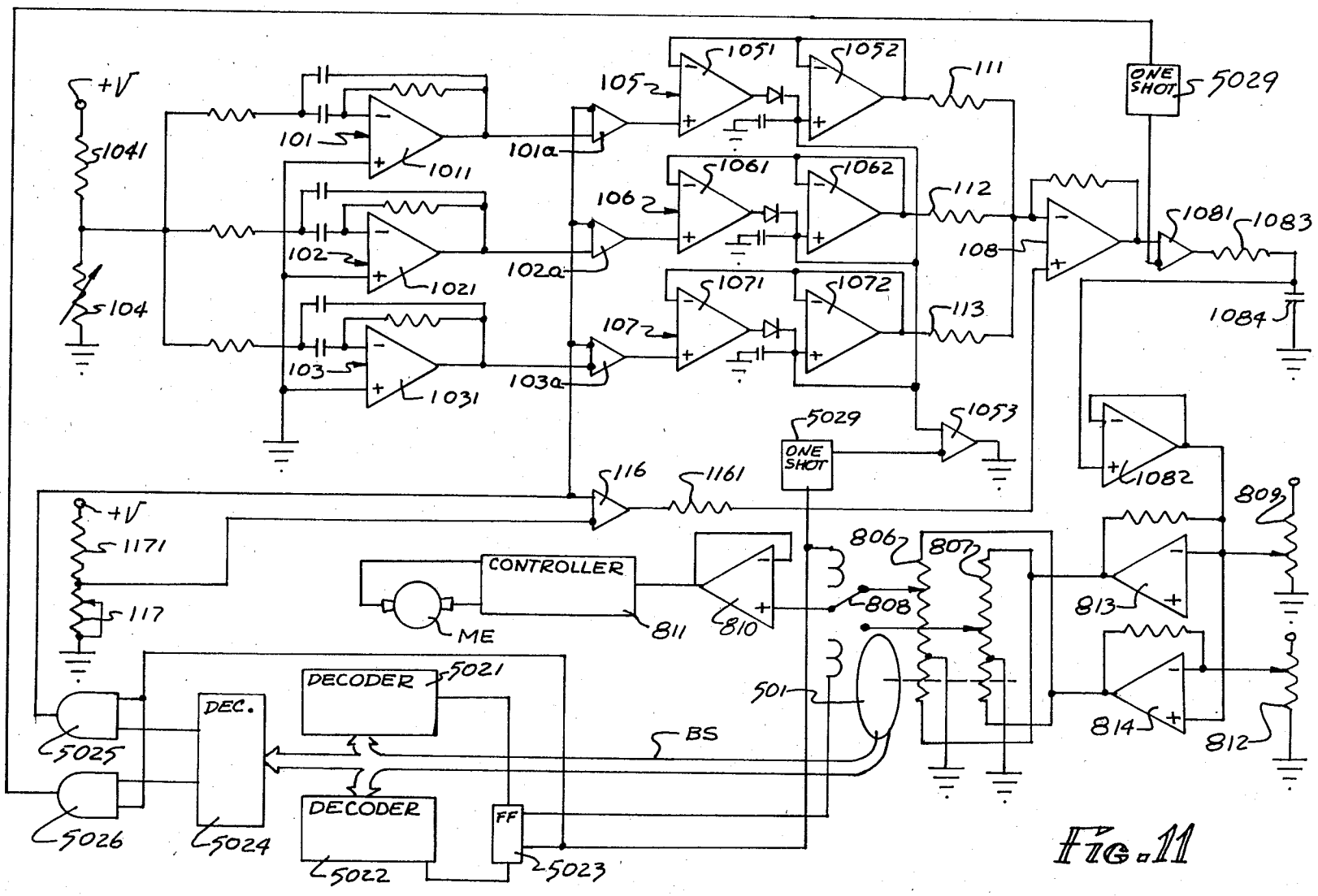
FIG. 11 is a circuit diagram of an inventive control system.

As shown in FIG. 11 the output of strain gauge 104 may be developed as a juncture of a voltage divider (or one side of a bridge network) including a serial connection of a resistor 1041. This circuit may be connected between a source of DC power +V and ground with the junction connected to the three bandpass filters 101, 102 and 103 each conformed as an active bandpass filter around a corresponding operational amplifier 1011, 1021 and 1031 and each straddling a harmonic of the rod string as determined by the following approximate relationship:

$$f_{center} = 10{,}000/1;\ 20{,}000/1;\ \text{and}\ 40{,}000/1$$

where 1 is the length of the rod string.

The outputs of filters 101, 102 and 103 are then fed, through the corresponding analog gates 101*a*, 102*a* and 103*a*, to corresponding peak detectors 105, 106 and 107 each formed around a pair of operational amplifiers 1051 and 1052, 1061 and 1062, and 1071 and 1072; the outputs of these detectors being summed at a summing amplifier 108 across the input resistors 111, 112 and 113 set to normalize the frequency component. Amplifier 108 also receives, at its other input, the output of analog gate 116 which passes, when gated, the reference signal RS across an input resistor 1161. Thus the input side of amplifier 108 forms the system summing node, connecting the bias signal RS with the peak spectral signal in each cycle. Peak detectors 105–107 are, furthermore, periodically cleared by an analog gate 1053.

The output of amplifier 108 is then applied across an analog gate 1081 to a sample and hold circuit conformed around an operational amplifier 1082 connected for unity feedback and including a charging resistor 1083 and a capacitor 1084 at the input thereof. Resistor 1083 provides a smoothing or "portamento" effect for any switching delays or transients and for rounding off any changes in the input signal. This output is then respectively applied to one end of two shaped potentiometers 806 and 807 connected in parallel, each including a grounding tap proximate the one end thereof. These potentiometers are mounted for rotation along with the shaft encoder 501 with the grounding taps corresponding to the upper and lower nominal stroke end positions. A switch 808 is alternatively pulled between the wipers of potentiometers 806 and 807 in accordance with an up UP and down DN signal developed by a latch 809 which, in turn, is gated by the shaft encoder 501 according to the description following. The output of switch 808 is then applied to the input of yet another amplifier 810. Concurrently the up and down nominal stroke rate signals are developed at the wipers of two potentiometers 811 and 812 tied between voltage Ve and ground potentiometer 811 being inverted through an inverting amplifier 813 while potentiometer 812 is amplified directly by an amplifier. More specifically, the output of amplifier 1082 is branched to sum with the potentiometer 811 and 812 signals and it is from thence that the potentiometers 806 and 807 are excited. In order to provide a negative bias to the potentiometer ends extending beyond the grounding taps these ends are reverse connected to the opposing amplifiers 813 and 814, thus assisting the reversal cycle.

Thus, during the course of each cycle, the error signal appearing at the output of amplifier 1082 is sampled and held until the next cycle. This error signal is summed in amplifiers 813 and 814 with the signal from potentiometers 811 and 812 to set the end voltages on potentiometers 806 and 807. The wiper signals from potentiometer s 806 and 807 then set the motor speed controlling the stroke rate of the drive DR.

The timing or position sequence selecting the appropriate signal from potentiometers 806 and 807, in turn, is developed from the output of shaft encoder 501. More specifically, the signals BS from the encoder are fed to an upper limit decoder 5021 and a lower limit decoder 5022 which by their outputs set or reset an SR flip flop 5023. Flip flop 5023 then articulates switch 808, selecting the appropriate potentiometer. Concurrently, signal BS is fed to yet another decoder 5024 which decodes the shaft position signal to determine the aperture at which the modal loads are taken. This aperture signal is fed to an AND gate 5025 which also receives the down side output of flip flop 5023 to produce the timing aperture signal GS to gates 101*a*, 102*a* and 103*a*. Decoder 5024, furthermore, opens yet another aperture through an AND gate 5026 again collecting the down output of flip flop 5023 to set off a one shot 5027 (monostable multivibrator) opening gate 1081 while the up side output of flip flop 5023 sets off a one shot 5029 to close a gate 1053 connected to discharge to ground the holding capacitors of peak detectors 105, 106 and 107, thus functioning as the signal GS.

The foregoing elements provide all the timing functions necessary to clear and load the strain gauge signal in each stroke. Once loaded the signal is maintained through the remainder of the stroke to control the motor ME. Beyond a direct linear output the potentiometers 806 and 807 may be shaped to modify the reversal period, thus limiting the spectral character of reversal to reduce stroke coupling into the rod string modes.

Figure 14:
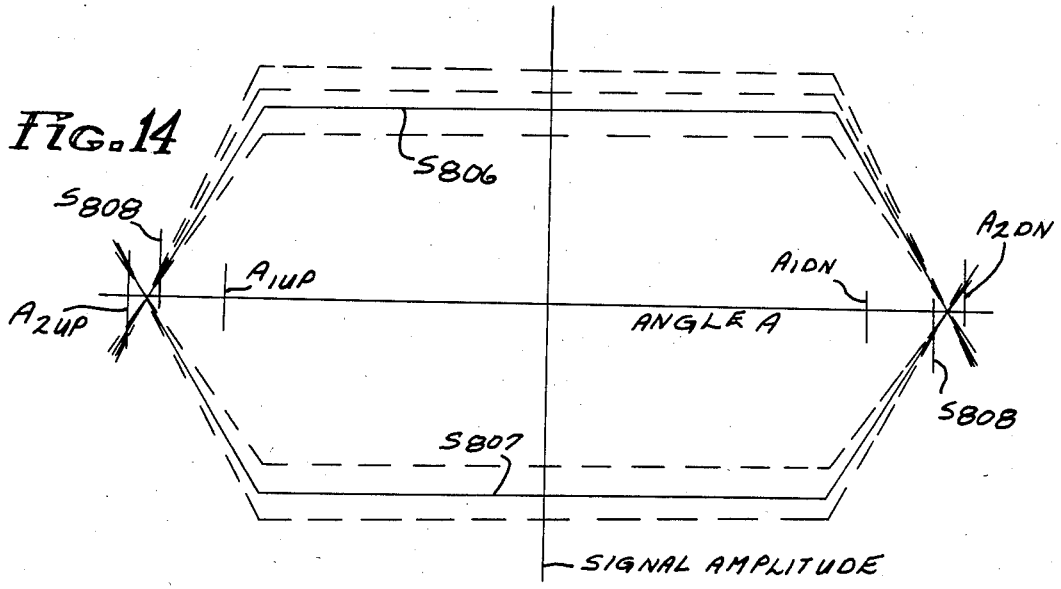
FIG. 14 is a diagram of an alternative implementation of the present control system.

Accordingly, as shown in FIG. 14, two shaped signals S806 and S807 are formed which vary with angle A and which vary in amplitude according to the outputs from amplifier 1082. The shaping itself may be selected such that some signal drop off begins occurring before the respective angles A1 are reached. Thus some reduction in the system's kinetic energy may be had before the reversing impulse occurs. This has the tendency to reduce the energy level in the reversal and, consequently, the frequency components therein, reducing any rod excitation that may result therefrom.

While there are various techniques through which the power of motor ME may be controlled in response to the output of amplifier 810 one convenient technique is through the use of a variable frequency controller 811 like that sold by Ramsey Controls Inc., Manwah, N.J. and described in their publication 389-5M "Ramsey Primer". This controller, in response to the polarity and amplitude of the input signal (from amplifier 810) varies the amplitude of the input signal (from amplifier 810) varies the amplitude, frequency and phase to the electrical motor ME to produce power and rate levels in relation to the signals S806 and S807. As result of such modifications in rate and power the stroke rate may be modified, thus producing a response to each change in the modal energy level that departs from the bias signal RS.

In the course of the foregoing discussion one should note that the dynamic model set out essentially ignores the large losses in the system attributed to the pumping of fluid. Simply, this highly linearized model is superposed in amplifiers 813 and 814 onto the steady state power level entailed in pumping, and is only put forth herein for the purpose of explaining the dynamic energy exchange. The power levels, set in potentiometers 811 and 812, however, provide a substantially high operating point and consequently any reduction in motor power is quickly exchanged for cycle rate. Thus one only needs to select the appropriate dynamic loop gain to select the desired response rate of the system.

Figure 15:
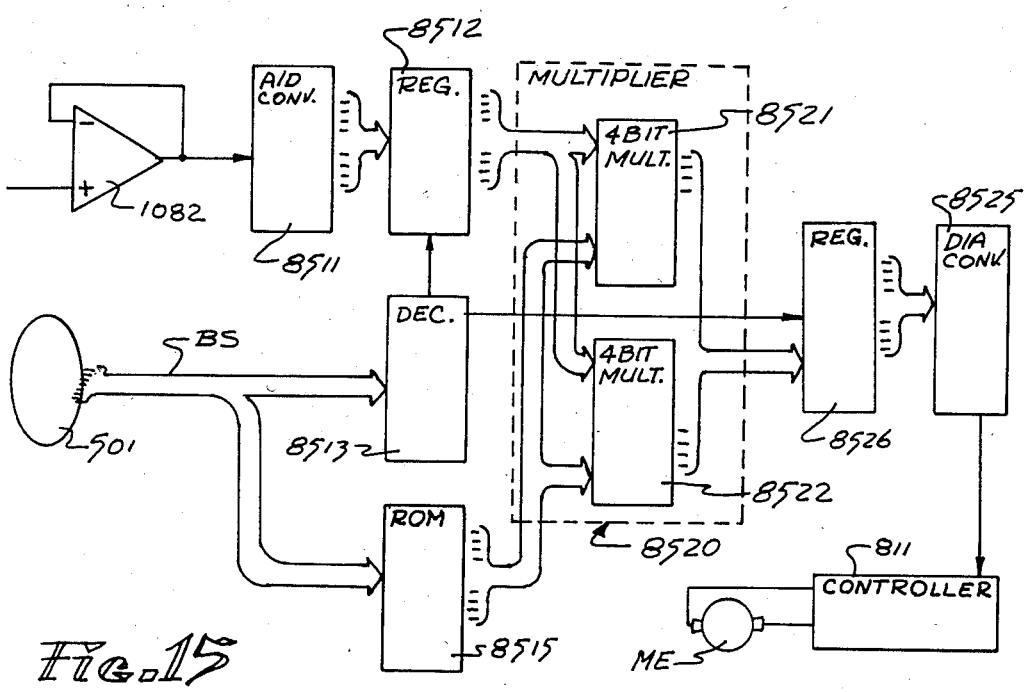
FIG. 15 is a diagram of an alternative implementation of the present control system.

A similar control arrangement may be achieved in digital implementation as shown in FIG. 15. As shown in this figure the output of amplifier 1082 is fed to an analog-to-digital (A/D) converter 8511 which, in turn, applies its outputs to the input terminals of a register 8512 which is strobed by a decoder 8513, at the end of the down stroke sequence of the shaft encoder 501. Thus register 8512 is loaded with the new spectral amplitude summation at the end of each stroke, providing a binary output indicating of this amplitude for the remainder of the stroke. This output is then multiplied with the output of a ROM 8515 which maps the output of encoder 501 into functions approximating the shaping achieved through potentiometers 806 and 807 in FIG. 11. More specifically, the output of register 8512 is fed in as one input to a binary multiplier 8520 which in its simplest form may comprise two 4×4 bit multiplier chips 8521 and 8522 connected to provide an 8-bit output, through an encoder 8526 to a digital-to-analog converter 8525. Converter 8525 then provides the signal input, controlling the electrical frequency to motor ME, to the aforementioned variable frequency controller 811.

In the foregoing digital implementation amplifier 1082, once again, may include the signal RS. Alternatively, register 8512 may be preloaded with a fixed count corresponding to the bias signal BS. Similarly, encoder 8526 may include fixed data leads corresponding to the nominal cycle rate which is then modified by the output of the multiplier. All the foregoing options, including the expansion of the multiplier to higher bit outputs, are well known expedients in the art and may be variously implemented without loss of generality (see, for example, the data sheets for the SN54284, SN54285 multipliers, published by Texas Instruments, P.O. Box 5012, Dallas, Tex. 75222 for exemplary multiplier expansion forms,) and the timing sequence may be implemented in a manner similar to that shown in FIG. 11.

Furthermore, the selection of bit width, or accuracy, will depend on such design considerations as the noise level in the strain gauge 104 and other background noise functions which, according to their intensity, will dictate the overall signal resolution.

Both the system set out in FIG. 11 and that set forth in FIG. 15 will produce equivalent outputs which may be variously sized in gain. (In this context one may want to note that the nanosecond switching rates of a digital system are virtually invisible to a pump drive operating in the seconds time domain.) This gain selection may be simply achieved without any substantial effect on the dynamics of the pump drive, since the once per stroke operation of the control system in itself acts as a digital filter.

Figure 13:
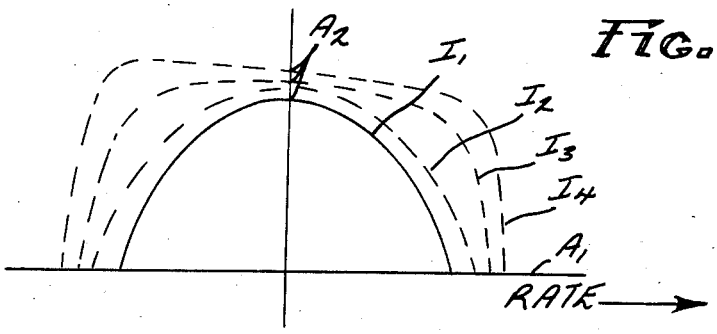
FIG. 13 is a graphic diagram of end impulse shapes controlled according to the present invention.

Thus the only limitation on gain is that arising in the reversal portions of the stroke. As previously put forth the dominant frequency component associated with reversals relates to the angular rate as g/R. The use of a variable frequency motor controller 811 allows for a reduction in the angular rate at angle $A_1$, thus allowing for lower energy levels at this state change, reducing the size of the reversal impulse and thus its frequency spectrum. Simply, as shown in FIG. 13 only small variations in $A_2$ occur as result of large variations in the angular rate (slope) at $A_1$. For larger rates, however, more of an abnormal impulse shape results $I_2$ and $I_3$ which according to Fourier will necessarily entail higher spectral components.

PHYSICAL IMPLEMENTATION

Figure 16:
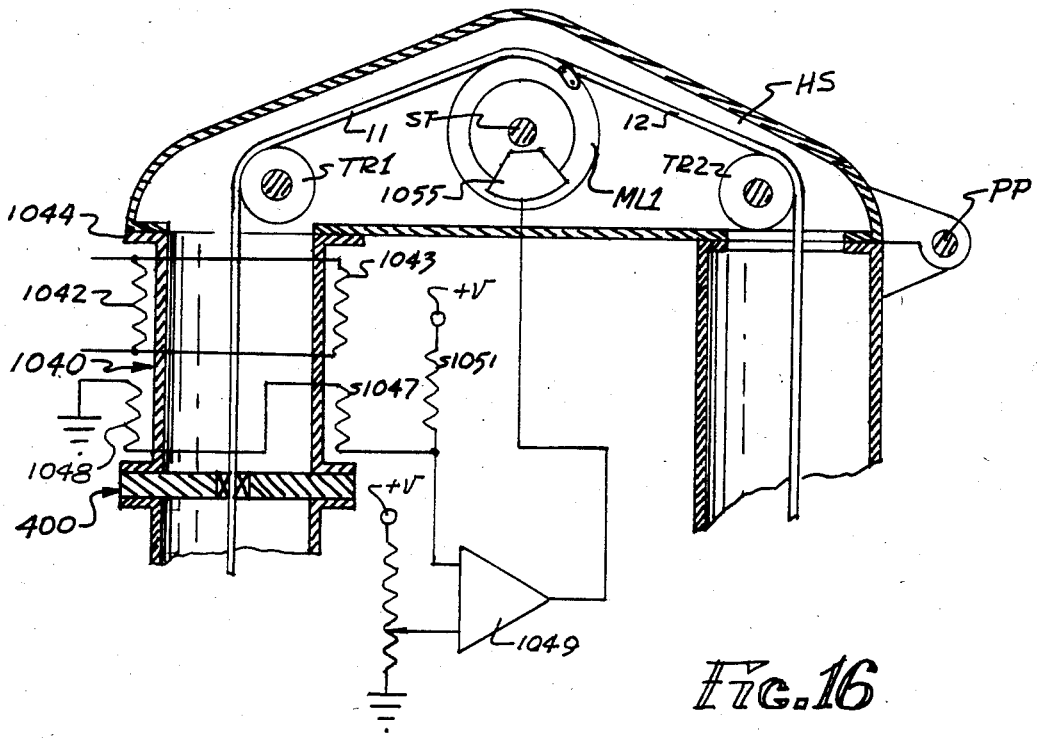
FIG. 16 is a side view of a counterbalanced pump assembly illustrating one manner of instrumenting same.

In the course of the foregoing explanatory portion of the disclosure certain assumptions were made for convenience in the presentation. For example, strain gauge 104 has been shown directly mounted on the turning roller mount leaving certain difficulties in the transmission of the load signal. To resolve this difficulty one may take reference to the illustration in FIG. 16 wherein the shaft ST is shown mounted between the lateral surfaces of a housing HS which is supported on a pivot point PP over the counterbalance pit with the other side supported on a pipe segment 1040 of known elastic characteristics which may then be bonded to a plurality of resistive elements 1042 and 1043 connected in parallel. Elements 1042 and 1043 form a resistive circuit equivalent to strain gauge 104 in alignment subjacent turning roller TR1. Since elements 1042 and 1043 may be deployed on opposite sides of segment 1040 an equivalent of a load cell is formed which is compensated for bending loads. Thus any lateral components of belt motion are separated from the longitudinal modes $W_1 \ldots W_n$. Segment 1040, furthermore, may include flanges ends 1044 and 1045 respectively attaching to housing HS and to the upper end of the well casing and thus may be lifted along with the housing allowing access to a seal assembly 400 through which belt 11 passes into the well pipe, described in more detail below. In addition, segment 1040 may be provided with further strain gauges 1047 and 1048 in a series circuit tied between signal + and the input of a comparator 1049 conformed to sense catastrophic load changes associated with belt or rod string separation.

Figure 17:
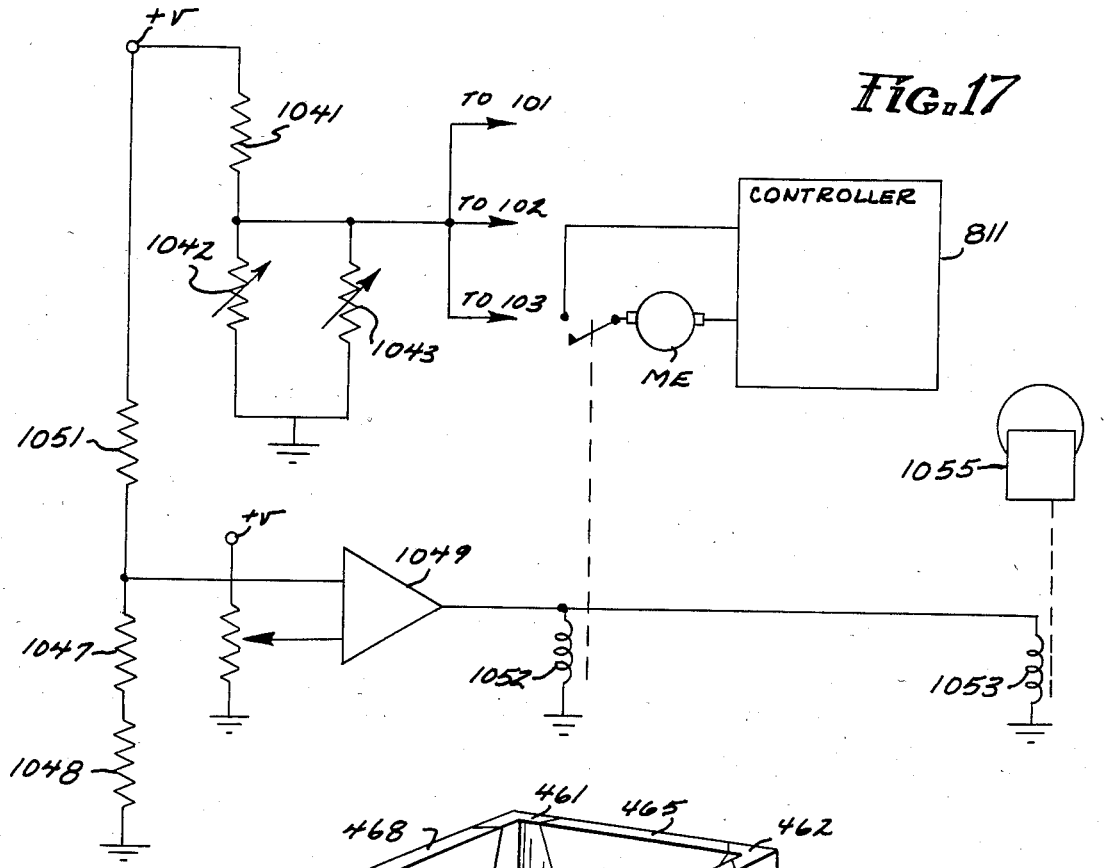
FIG. 17 is a circuit diagram for use with the structure shown in FIG. 16.

Thus as shown in FIG. 17 elements 1042 and 1043 form a parallel connection from one end of resistor 1041, in equivalent function to gauge 104. Resistor 1041 may be a variable resistor providing adjustment of the potential of the junction tied to the filters 101, 102 and 103. Elements 1047 and 1048, on the other hand, are connected in series with a resistor 1051 to produce a large signal change at the junction therewith by which comparator 1049 is switched. Comparator 1049 may then operate relays 1052 and 1053 opening the circuit between source E and the controller 811 and engaging a brake 1055.

Thus segment 1040 provides all the requisite instrumentation to monitor rod load and also allows access for any seal maintenance.

Figure 18:
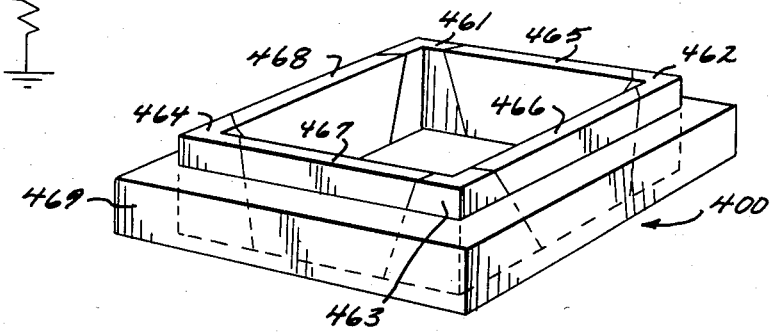
FIG. 18 is a perspective illustration of an inventive seal useful with the present invention.
Figure 20:
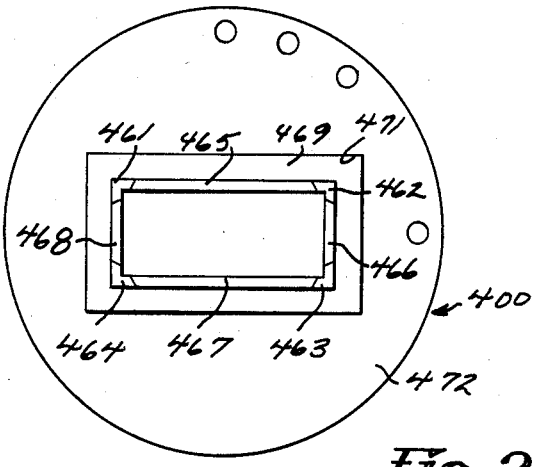
FIG. 20 is a top view of the seal assembly shown in FIG. 18.
Figure 19:
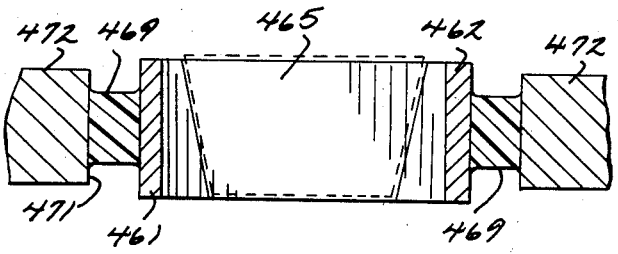
FIG. 19 is a side view, in section, of the seal shown in FIG. 18.

As shown in FIGS. 18, 19 and 20, seal assembly 400 may be conformed to include four corner wedges 461, 462, 463 and 464 each defining an L-shaped surface and each including tapered edges opposing corresponding edges in wedge segments 464, 466, 467 and 468. The edge taper and inclination in the corner wedges 461, 462, 463 and 464 is aligned to force the wedge segments 465, 466, 467 and 468 inwardly into the rectangular cavity defined thereby to press against the surfaces of belt 11. On the upward translation of the belt segments 465–468 are pulled upward decreasing the spread between the corner wedges to thus improve sealing contact. On the downward stroke the surface friction on segments 465–468 acts to spread out the corner segments reducing sealing contact. Wedges 461–464 and segments 465–468 may be bonded or adhesively attached to a resilient peripheral sleeve 469 of rectangular plan form which, in turn, is fitted and attached to the interior surfaces of a rectangular opening 471 formed in a flange 472 covering the upper end of the well pipe WP. Segments 465–468 and wedges 461–464 may be formed of a material structure having low coefficients of friction like Teflon, to reduce the energy loss in the use thereof.

Thus, all the necessary provisions are made for developing the rod load signals and for sealing off the flat composite belt to effect pumping. Consequently the extension of the composite belt into the well bore may be effected, with the attendant reductions in belt size and increase in resonance.

By virtue of this change the control bandwidth is expanded allowing for an increased range in the variation of the stroke rate which is further enhanced by the variable frequency drive. The selection of a variable frequency drive has the advantage in that considerations of fixed speed are no longer in effect. Thus turn on and turn off transients are no longer a consideration since motor rate has simply become a function of frequency input. Having thus resolved the motor start and stop concern, the necessity for expanded power segments, at fixed rates, is also resolved, thus resolving the problem incident to the end impulse. Simply, the shaping of potentiometers 806 and 807 or the functions in ROM may be selected such that some stroke round-off takes place before the onset of the end impulse between the angles $A_1$ and $A_2$. Furthermore, since motor power may be carried into the end impulse even the impulse itself may be shaped. Thus close control over the reversing impulse frequency spectrum, a phenomenon crowding the operating bandpass, may be achieved which, when combined with the bandwidth expansion available through the use of composites, renders coherent control over pump-off both feasible and economic.

Figure 21:
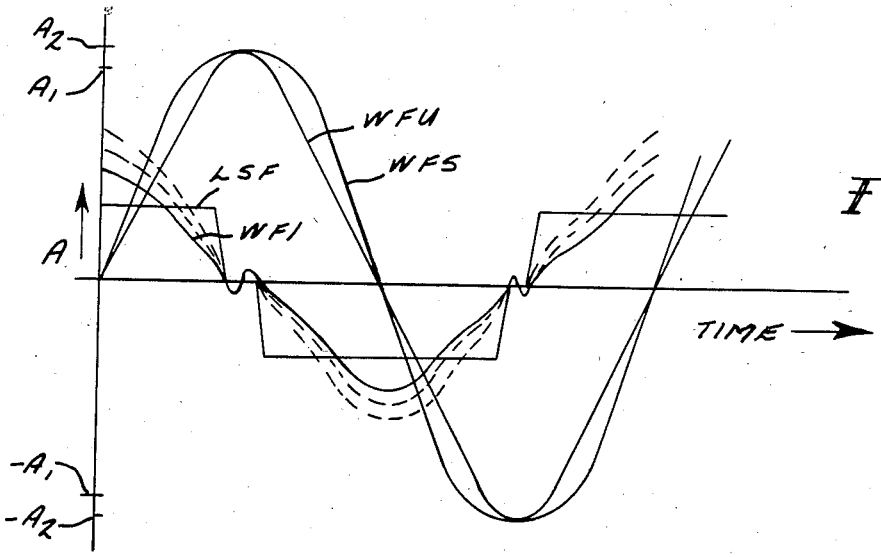
FIG. 21 is a graphic diagram of the shaping functions useful with the present invention.

As shown in FIG. 21 the cycle wave form for a system utilizing on-off motor input WFU includes higher frequency impulses between angles $A_1$ and $A_2$ and $-A_1$ and $-A_2$. These waveforms may be reshaped to a wave form WFS which more closely approximates a sine wave by insertion of motor torque following the waveform WFI which, in area, is equal to the loading step function LSF providing the shaping function to convert waveform WFU to WFS. Any change in scale of waveform WF1 will thus be available to modity the stroke rate, which while of some consequence to the end impulse will still maintain a substantially sinusoidal character.

By mapping the function LSF against angle A of an idealized sine wave in ROM 8515, for example, (or in the shapes of potentiometers 806 and 807) a shape of motor frequency is obtained which inherently will force cycle spectra in a single frequency band close to the cycle rate. This cycle rate can then be pushed to the resonance limits of the rod string, as set by the bias signal RS, or to any incipiency of pump-off. In this manner all of the energy conserved through the use of reversing impulse may be retained since such is determined by the excursion of the stroke between angles $\pm A_1$ and $\pm A_2$ while at the same time providing a narrow spectrum in each stroke by which rod string resonance may be excited. Thus this increase in bandwidth is essentially obtained at no energy cost. More importantly, some energy saving is inherently achieved since the high loss starting and stopping transients of a fixed rate motor are virtually eliminated.

Figure 22:
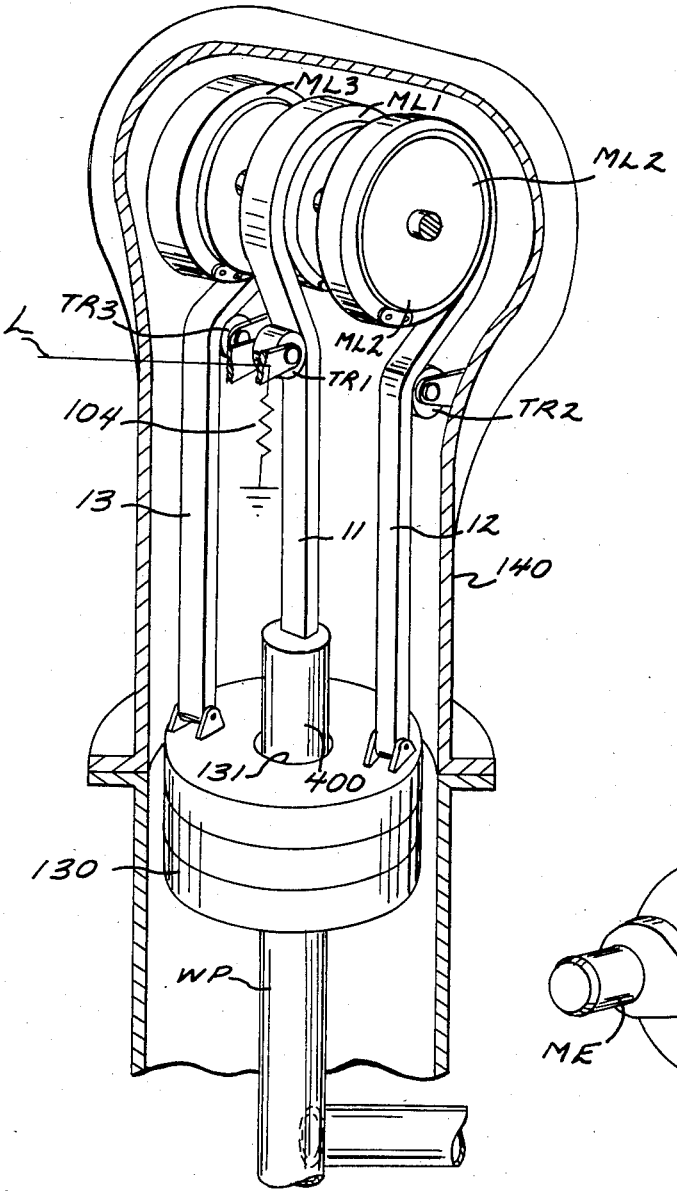
FIG. 22 is a perspective illustration, in partial section, of an alternative structural arrangement of a counterbalanced pump.
Figure 23:
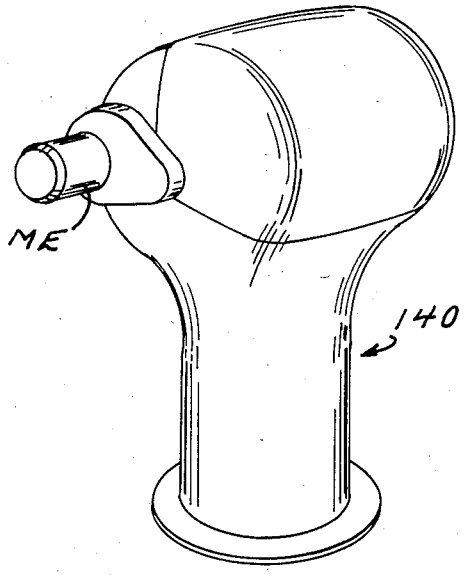
FIG. 23 is an exterior view of the structure shown in FIG. 22.

The use of composite fiber structures, furthermore, results in substantial reductions in belt sections allowing for increased clearances within the well bore. With these clearances further improvements are possible in the construction of the counterbalanced pump. As shown in FIGS. 22 and 23 a three mandrel arrangement may be provided comprising mandrels ML1, ML2 and ML3 with mandrels ML2 and ML3 deployed on shaft ST on either side of mandrel ML1. Two counterbalance belts 12 and 13 may then be wrapped around the peripheries of mandrels ML2 and ML3 to extend into the interior of the well bore to support an annular counterbalance 130 therein. Belt 11 is, in turn, wrapped in the opposite direction around mandrel ML1 and extends therefrom to pass into the interior of a raised well pipe WP which passes through the annulus 131 of the counterbalance 130 and contains the rod string 20. Thus both the counterbalance and the pump rods reside in the well bore rendering unnecessary a separate counterbalance pit. As result of this arrangement the complete pumping mechanism may be directly mounted on a well head, enclosed in a housing 140, which thus will trap any well products leaking past the seals. The seal itself may be conformed similar as seal 1046 on the upper end of the well pipe.

To achieve load sensing, the mount for roller TR1 may be instrumental with strain gauge 104 for sensing the belt loads. This configuration may then be controlled in a manner similar to the above teachings and may be sealed by mounting the seal assembly 400 on the top of the well pipe.

One may also note that the bandwidth may be further improved by incorporating the well known techniques of rod taper. Thus wide bandpasses may be obtained in the system which renders any problem of pump to well matching substantially simpler thus rendering the pump drive more generally adaptable in the field with the result that a single drive can be used over a wide range of wells.

Obviously many modifications and changes may be made to the foregoing description without departing from the spirit of the invention. It is therefore intended that the scope of the invention be determined solely on the claims appended hereto.

What is claimed is:

1. Apparatus for controlling the stroke rate of a reciprocation pump provided with a suspended pump rod, comprising:

sensing means operatively connected to sense the amplitudes of elastic motion of said pump rod, said elastic motion of said rod being characterized by a plurality of characteristic modes, said sensing means including isolating means conformed to select certain ones of said modes, for producing a sensing signal indicative thereof;

a variable prime mover connected to articulate said pump at a stroke rate corresponding to a control signal; and control means connected to receive said sensing signal and including inverting means for producting said control signal in substantially inverse relationship therewith.

2. Apparatus according to claim 1 wherein:

said pump includes stroke position indicating means for producing a position signal to said sensing means for enabling said peak detection means at a preselected point in said stroke.

3. Apparatus according to claim 1 wherein:

said isolating means includes peak detection means for storing the peak amplitudes of said certain ones of said modes in the course of each stroke.

4. Apparatus according to claim 1 wherein:

said rod includes reinforced material structure comprising aramid fibers.

5. Apparatus for controlling the stroke rate of an oil well pump provided with a suspended rod string characterized by a plurality of characteristic modes of elastic motion for maintaining the energy level of selected ones of said modes of motion below a predetermined level, comprising:

a prime mover connected to said pump for articulation thereof at a stroke rate corresponding to the amplitude of a control signal;

sensing means operatively connected to isolate and sense the energy levels in said selected modes of motion of said rod string during selected periods of each stroke for producing a sensing signal indicative of a cumulation of said energy levels; and control means connected to receive said sensing signal and including inverting means for producing said control signal in substantially inverse relation therewith.

6. Apparatus according to claim 5 wherein:

said prime mover includes an alternating current electric motor; and said control signal is an electric signal of varying current frequency and amplitude.

7. Apparatus according to claim 6 wherein:

said control means includes shaping means for modifying the current frequency and amplitude of said control signal according to the position of said stroke.

8. Apparatus according to claim 7 wherein:

said shaping means is conformed to control said prime mover to produce a substantially sinusoidal character of motion in said stroke.

9. In a counterbalanced well pump including a first and second mandrel mounted for common rotation on a shaft each mandrel supporting in a spiral stack about the periphery thereof aligned for opposite deployment a corresponding first and second flexible belt, said first belt being attached at the free end thereof to a rod string extending into said well bore and said second belt being attached at the free end thereof to a counterbalance, said rod string being characterized by a plurality of modes of elastic motion, the improvement comprising:

an alternating current electrical motor operatively connected to articulate in rotation said first and second mandrels;

sensing means operatively connected to said pump to isolate and sense the amplitude of selected ones of said modes of elastic motion of said rod string for producing a sensing signal indicative of a cumulation thereof; and control means connected to receive said sensing signal including inverting means for producting an output signal to said electrical motor of a frequency and amplitude substantially inverse with said sensing signal.

10. Apparatus according to claim 9 wherein:

said sensing means further includes stroke position means for providing a position signal indicative of the stroke position of said pump and peak detecting means rendered operative by said position signal for storing the peak amplitudes of said sensing signal.

11. Apparatus according to claim 10 wherein:

said control means includes a variable frequency controller.

12. Apparatus according to claim 9 wherein:

said rod string includes aramid fiber reinforced composite materials.

13. Apparatus according to claim 12 wherein:

said first and second belts include aramid fiber reinforced composite materials.

* * * * *